United States Patent [19]

Yanagida et al.

[11] 4,243,438

[45] Jan. 6, 1981

[54] PRODUCTION OF ALUMINUM IMPACT EXTRUSIONS

[75] Inventors: Kiyomi Yanagida, Suita; Harumi Magusa, Gifu; Akihiko Takahashi, Nagoya, all of Japan

[73] Assignees: Sumitomo Aluminium Smelting Co., Ltd., Osaka; Nihon Atsuen Kogyo K.K., Itami, both of Japan

[21] Appl. No.: 58,661

[22] Filed: Jul. 18, 1979

[30] Foreign Application Priority Data

Jul. 21, 1978 [JP] Japan ..... 53-89708
Feb. 21, 1979 [JP] Japan ..... 54-19523
Feb. 21, 1979 [JP] Japan ..... 54-19524

[51] Int. Cl.[3] ..... C22F 1/04
[52] U.S. Cl. ..... 148/11.5 A; 75/138; 148/32
[58] Field of Search ..... 75/138; 148/11.5 A, 148/32

[56] References Cited

U.S. PATENT DOCUMENTS 3,830,635 8/1974 Chia et al. ..... 75/138

*Primary Examiner*—R. Dean
*Attorney, Agent, or Firm*—Wenderoth, Lind & Ponack

[57] ABSTRACT

The present invention relates to a method of producing an aluminum impact extrusion by preparing a slug of an aluminum based alloy made of aluminum and at least one element selected from cobalt and nickel, whereas the amounts of the cobalt and nickel are each present in amounts of 3% by weight or less and wherein the total amount of cobalt and nickel is 0.15% by weight or more; impact extruding the slug by using an impact extrusion press, and then annealing the extruded product. The present invention also involves an aluminum base alloy consisting of the ingredients mentioned above useful for impact extrusion and an aluminum collapsible tube prepared by impact extruding a slug stud of an aluminum base alloy of the type described above.

11 Claims, No Drawings

PRODUCTION OF ALUMINUM IMPACT EXTRUSIONS

BACKGROUND OF THE INVENTION

A. Field of the Invention

The present invention relates to a method of producing aluminum impact extrusions having high ductility, and more particularly to a method of producing highly ductile impact extrusions having outstanding subsequent fabrication characteristics from slugs of aluminum base alloy containing cobalt and/or nickel by impact extruding the slug by an impact press and annealing the extruded product.

B. Description of the Prior Art

Impact extrusions can be produced from any commercial aluminum alloy, but the stock most extensively used for impact extrusion is a commercial pure aluminum having a purity of 99.5 to 99.8% by weight because of its impact extrusion characteristics and its properties in the finished product. Collapsible tubes, for example, are produced by impact extruding a slug of commercial pure aluminum having a purity of 99.7% by weight or more and annealing the resulting extrusion to the state of soft temper. The tubes are used as containers for toothpastes, foods, drugs, etc.

However, such collapsible tubes, when filled with contents, are liable to break where they are frequently flexed during repeated use, possibly permitting leakage of the contents. It is therefore desired to provide collapsible aluminum tubes which are not easily breakable. To assure economy of transport, there is also a great demand for collapsible taper tubes which are prepared from impact extrusions by subsequent fabrication. Various other impact extrusion products are similarly produced by subjecting impact extrusions to necking, drawing or the like. Conventional impact extrusion products nevertheless are not always satisfactory in subsequent fabrication characteristics but are likely to break or become otherwise defective in the course of subsequent fabrication. Thus it is also desired to develop aluminum impact extrusions having outstanding subsequent fabrication characteristics.

SUMMARY OF THE INVENTION

An object of the present invention is to provide aluminum base alloys suitable for producing impact extrusions having excellent ductility.

Another object of the invention is to provide a method of producing impact extrusions having excellent ductility.

Another object of the invention is to provide a method of producing collapsible tubes by an impact extrusion process which tubes are not easily breakable.

Still another object of the invention is to provide a method of producing impact extrusions having improved subsequent fabrication characteristics.

To fulfil these objects, we have conducted extensive research and accomplished the present invention based on the finding that the foregoing drawbacks and problems can be overcome by impact extruding a slug stock of an aluminum base alloy consisting essentially of aluminium and containing cobalt and/or nickel.

The slug stocks useful in this invention for the production of impact extrusions are made of an aluminum base alloy consisting essentially of aluminum and at least one element selected from the group consisting of up to 3% by weight of cobalt and up to 3% by weight of nickel, the total amount of the cobalt and the nickel being at least 0.15% by weight. Stated more specifically, the present invention provides a method of producing an impact extrusion having high ductility and outstanding subsequent fabrication characteristics by impact extruding a slug of an aluminum base alloy by an impact extrusion press and annealing the extruded product, the aluminum base alloy consisting essentially of aluminum and at least one element selected from the group consisting of cobalt and nickel, the content of each of said cobalt and nickel being 3% by weight or less and the total amount of said cobalt and nickel being at least 0.15% by weight.

DESCRIPTION OF THE PREFERRED EMBODIMENTS

The present invention will be described below in greater detail.

The aluminum base alloys to be subjected to impact extrusion as slug stocks according to this invention must consist essentially of cobalt and/or nickel each in an amount of up to 3% by weight, the total amount of the cobalt and the nickel being at least 0.15% by weight. If the total amount of the cobalt and the nickel is less than 0.15% by weight, a satisfactory improvement will not be achieved in ductility nor in subsequent fabrication characteristics, whereas with more than 3% by weight of cobalt or nickel present, the alloy will not have improved properties corresponding to the increased amount but becomes unjustifiably costly.

Aluminum alloys containing cobalt alone, if selected for use, preferably contain 0.2 to 2.0% by weight of cobalt, more preferably 0.2 to 1.2% by weight of cobalt.

Alloys incorporating nickel only, if useful, preferably contain 0.2 to 2% by weight of nickel, more preferably 0.3 to 1.5% by weight of nickel.

With alloys containing both cobalt and nickel, it is desirable that these elements be present each in an amount of at least 0.05% by weight and in a total amount of at least 0.15% by weight so that each element will impart the desired effect to the alloys. Especially preferable to use are aluminum alloys comprising 0.2 to 2% by weight of cobalt and 0.2 to 2% by weight of nickel in a total amount of 3% by weight or less since these alloys have remarkably improved ductility.

When annealed, such alloys containing both cobalt and nickel exhibit improved ductility over Al-Co alloys or Al-Ni alloys as well as over pure alluminum. Moreover the alloys have a reduced recrystallizing temperature and can therefore be annealed under moderate conditions. Thus they are useful when it is desired to produce articles of especially high ductility or to conduct the annealing treatment at a lower temperature within a shorter period of time for the reduction of energy cost.

Although the aluminum serving as the base of useful alloys is not particularly limited in purity, it is preferable to use commercial pure aluminum having a purity of 99.5% by weight or higher, more advantageously 99.7% or higher. The objects of this invention can then be fulfilled with the desired result without being influenced by the contents of, and the ratio between, Fe and Si which are the main impurities involved.

The impact extrusions of this invention can be produced in the same manner as the conventional impact extrusion process under the same conditions as usually used for impact extruding slugs of commercial pure aluminum. The impact extrusion press to be used may be of any type, such as a reverse impact press, forward impact press, lateral impact press, combination forward and reverse impact press or the like. The most suitable press may be used in accordance with the shape of the impact extrusion product as finished. The shape of the slug stock is also dependent on that of the finished extrusion product. Useful slugs are prepared from impact extrusion stocks, such as rolled plates, extruded plates, extruded rods or the like, made of the aforementioned aluminum base alloy by machining the stock to a shape in conformity with the shape of the finished product as by blanking, sawing or trimming. Generally the slug is subjected to annealing heat treatment to the state of soft temper by being heated to a temperature, for example, of about 300° to about 600° C. for a period of time suited to the desired degree of impact extrusion processing, then coated with a lubricant as by tumbling, dipping or centrifuging, and thereafter impact extruded at or near room temperature. Examples of suitable lubricants are various metal soaps such as zinc stearate, sodium stearate, aluminum stearate or the like. The slug may be slightly heated and then impact extruded depending on the shape and extrusion degree of the product contemplated.

According to the method of this invention, the extruded product thus obtained is annealed and thereby softened, giving an impact extrusion with much higher ductility than is afforded by the use of commercial pure aluminum as a slug stock. Although the annealing conditions are dependent on the size and design of the extruded product, the product is usually heated at a temperature of about 150° C. to about 600° C. for about 1 to about 30 minutes.

When aluminum alloys containing cobalt or nickel only are used, the preferred annealing temperature is not lower than 300° C., whereas those containing both cobalt and nickel can be fully softened even at about 150° C. since such alloys have a lower recrystallizing temperature as already described.

The collapsible tubes and various other impact extrusion products obtained by the foregoing method of the invention from aluminum base alloys containing cobalt and/or nickel by impact extruding the alloys and annealing the resulting extrusions afford finished products having higher ductility and less breakable than conventional like products. The annealed collapsible tubes and various other impact extrusion products can be subjected to subsequent fabrication such as trimming, curling, expanding, sizing, tapering, necking or bending with a reduced occurrence of faults or imperfections.

The present invention will be described below with reference to examples, to which the invention is not limited.

EXAMPLE 1

Commercial pure aluminum and Al-5% Co mother alloy were used to prepare sheet ingots of the Al-Co alloys listed in Table 1. Each of the ingots was hot rolled and then cold rolled into a plate 5 mm in thickness. Slug stocks, 38 mm in diameter, where blanked out from the plate and suitably trimmed for use as slug stocks for collapsible tubes. The slugs obtained were annealed at 600° C. for 4 minutes and then impact extruded at room temperature into collapsible tubes, 150μ in wall thickness. Table 2 shows the mechanical properties of the extruded products.

TABLE 1

| Alloy No. | Composition (wt. %) Fe | Si | Cu | Co | Al |
|---|---|---|---|---|---|
| 1. This invention | 0.15 | 0.07 | 0.00 | 0.43 | Balance |
| 2. This invention | 0.15 | 0.07 | 0.00 | 1.04 | Balance |
| 3. Base pure Al | 0.16 | 0.07 | 0.00 | 0.00 | Balance |
| 4. This invention | 0.05 | 0.05 | 0.00 | 0.43 | Balance |
| 5. Base pure Al | 0.05 | 0.05 | 0.00 | 0.00 | Balance |

TABLE 2

| Alloy No. | Tensile strength ($kg/mm^2$) | Yield strength ($kg/mm^2$) | Elongation (%) |
|---|---|---|---|
| 1 | 15.2 | 8.9 | 0.5 |
| 2 | 15.0 | 8.7 | 0.6 |
| 3 | 14.4 | 7.3 | 0.2 |
| 4 | 13.2 | 7.0 | 0.6 |
| 5 | 13.7 | 9.2 | 0.6 |

The extruded products thus prepared were annealed at 500° C. for 6 minutes to obtain collapsible tubes of soft temper. Table 3 shows the mechanical properties of the annealed collapsible tubes in comparison with those of collapsible tubes prepared in the same manner as the treatment of the commercial pure aluminum slugs.

TABLE 3

| Alloy No. | Tensile strength ($kg/mm^2$) | Yield strength ($kg/mm^2$) | Elongation (%) | Breaking test (times)* |
|---|---|---|---|---|
| 1 | 6.3 | 2.8 | 32.8 | 33 |
| 2 | 6.7 | 3.2 | 34.7 | 40 |
| 3 | 6.5 | 3.7 | 13.0 | 19 |
| 4 | 5.7 | 3.0 | 38.0 | 48 |
| 5 | 4.6 | 2.8 | 11.6 | 22 |

*The number of times the tube, as supported at one end, was repeatedly flexed through 180 degrees before breaking.

EXAMPLE 2

Commercial pure aluminum and Al-10% Ni mother alloy were used to prepare the Al-Ni alloys shown in Table 4.

TABLE 4

| Alloy No. | Composition (wt. %) Fe | Si | Cu | Ni | Al |
|---|---|---|---|---|---|
| 6. This invention | 0.15 | 0.07 | 0.00 | 0.60 | Balance |
| 7. This invention | 0.15 | 0.07 | 0.00 | 0.99 | Balance |
| 8. Base pure Al | 0.16 | 0.07 | 0.00 | 0.00 | Balance |

Each of the alloys was cast and rolled into a plate of 6 mm in thickness, which was blanked to obtain slugs 19 mm in outside diameter. The slugs were annealed at 380° C. for 12 hours and then impact extruded into tubes having a wall thickness of 120μ.

Table 5 shows the mechanical properties of the tubes as impact extruded and also as further annealed at 450° C. for 10 minutes, in comparison with those of usual tubes prepared by the conventional method.

TABLE 5

| Alloy No. | After impact extrusion: Tensile strength ($kg/mm^2$) | Elongation (%) | After annealing: Tensile strength ($kg/mm^2$) | Elongation (%) |
|---|---|---|---|---|
| 6 | 10.9 | 0.4 | 6.6 | 24 |
| 7 | 11.5 | 0.2 | 7.0 | 23 |
| 8 | 12.0 | 0.2 | 6.8 | 13 |

EXAMPLE 3

Commercial pure aluminum, Al-5% Co mother alloy and Al-10% Ni mother alloy were used to prepare the Al-Co, Al-Ni and Al-Ni-Co alloys listed in Table 6.

TABLE 6

| Alloy No. | Composition (wt. %) | | | | | |
|---|---|---|---|---|---|---|
| | Fe | Si | Cu | Co | Ni | Al |
| 9. This invention | 0.12 | 0.04 | 0.00 | 0.59 | 0.00 | Balance |
| 10. This invention | 0.12 | 0.04 | 0.00 | 0.00 | 0.58 | Balance |
| 11. This invention | 0.11 | 0.04 | 0.00 | 0.40 | 1.00 | Balance |
| 12. This invention | 0.09 | 0.04 | 0.00 | 0.41 | 0.52 | Balance |
| 13. This invention | 0.07 | 0.04 | 0.00 | 1.09 | 0.40 | Balance |
| 14. Base pure Al | 0.12 | 0.04 | 0.00 | 0.00 | 0.00 | Balance |

Each of the alloys was cast in a mold to obtain a 20-mm-thick sheet, the surfaces of which are grounded. The sheet was preheated at 530° C. and hot rolled to a thickness of 6 mm. Slugs, 38 mm in outside diameter, were blanked out from the plate, annealed at 380° C. for 12 hours and thereafter impact extruded into tubes 130μ in wall thickness.

For annealing, some of the tubes were held immersed in a hot bath at 200° C. or 400° C. for 10 or 30 minutes. The tubes as impact extruded and those further annealed were tested for tensile strength with the results given in Table 7 and also for elongation with the results listed in Table 8.

TABLE 7

| Alloy No. | Tensile Strength (kg/mm²) | | |
|---|---|---|---|
| | As impact extruded | 200° C. 30 min | 400° C. 10 min |
| 9 | 18.0 | 15.0 | 7.8 |
| 10 | 16.8 | 14.5 | 7.7 |
| 11 | 20.5 | 13.4 | 9.7 |
| 12 | 20.3 | 14.5 | 8.3 |
| 13 | 20.7 | 13.4 | 9.5 |
| 14 | 17.0 | 15.5 | 6.8 |

TABLE 8

| Alloy No. | Elongation (%) | | |
|---|---|---|---|
| | As impact extruded | 200° C. 30 min | 400° C. 10 min |
| 9 | 0.4 | 2.7 | 27 |
| 10 | 0.4 | 2.5 | 24 |
| 11 | 0.5 | 14 | 33 |
| 12 | 0.4 | 10 | 30 |
| 13 | 0.5 | 12 | 31 |
| 14 | 0.3 | 3.5 | 12 |

What is claimed is:

1. In a method of producing an aluminum impact extrusion by impact extruding a slug stock of an aluminum base alloy using an impact extrusion press and then annealing the extruded product, the improvement for producing an impact extrusion having excellent ductility, increased amenability to repeated flexure, enhanced strength against rupture and improved subsequent fabrication characteristics, which comprises using, as the slug stock, an aluminum base alloy consisting essentially of aluminum and 0.2 to 2.0% by weight of cobalt, or an aluminum base alloy consisting essentially of aluminum and 0.2 to 2.0% by weight of nickel and annealing the extruded product at a temperature of 150° to 600° C.

2. In a method of producing an aluminum impact extrusion by impact extruding a slug stock of an aluminum base alloy using an impact extrusion press and then annealing the extruded product, the improvement for producing an impact extrusion having excellent ductility, increased amenability to repeated flexure, enhanced strength against rupture and improved subsequent fabrication characteristics, which comprises using, as the slug stock, an aluminum base alloy consisting essentially of aluminum, cobalt and nickel, the content of each of said cobalt and nickel being 3% by weight or less and the total amount of said cobalt and nickel being 0.15% by weight or more, and annealing the extruded product at a temperature of 150° to 600° C.

3. The method according to claim 1, said aluminum base alloy consists essentially of aluminum and 0.2to 1.2% by weight of cobalt.

4. The method according to claim 1, said aluminum base alloy consists essentially of aluminum and 0.3 to 1.5% by weight of nickel.

5. The method according to claim 2, wherein said annealing treatment is carried out for 1 to 30 minutes.

6. The method according to claim 1, wherein said aluminum impact extrusion is an aluminum collapsible tube.

7. The method according to claim 2, wherein said aluminum impact extrusion is an aluminum collapsible tube.

8. The method according to claim 1, wherein said annealing treatment is carried out at a temperature of about 300°0 to 600° C.

9. The method according to claim 2, wherein said aluminum base alloy consists essentially of aluminum, 0.05 to 3% by weight of cobalt and 0.05 to 3% by weight of nickel.

10. The method according to claim 9, wherein the content of each of said cobalt and nickel is 0.2 to 2% by weight and the total amount of said cobalt and nickel is 3% by weight or less.

11. The method according to claim 1, wherein said annealing treatment is carried out for 1 to 30 minutes.

* * * * *